US011193363B2

(12) United States Patent
Melo Uribe et al.

(10) Patent No.: US 11,193,363 B2
(45) Date of Patent: Dec. 7, 2021

(54) STEERING CONTROL OF A DRILLING TOOL

(71) Applicant: Gyrodata, Incorporated, Houston, TX (US)

(72) Inventors: Javier Mauricio Melo Uribe, Houston, TX (US); Adrián Guillermo Ledroz, Houston, TX (US); John Lionel Weston, Christchurch (GB)

(73) Assignee: Gyrodata, Incorporated, Houston, TX (US)

( * ) Notice: Subject to any disclaimer, the term of this patent is extended or adjusted under 35 U.S.C. 154(b) by 235 days.

(21) Appl. No.: 16/208,354

(22) Filed: Dec. 3, 2018

(65) Prior Publication Data

US 2019/0169974 A1 Jun. 6, 2019

Related U.S. Application Data

(60) Provisional application No. 62/594,462, filed on Dec. 4, 2017.

(51) Int. Cl.
*E21B 44/02* (2006.01)
*E21B 7/06* (2006.01)
(Continued)

(52) U.S. Cl.
CPC ..... *E21B 44/02* (2013.01); *E21B 7/06* (2013.01); *E21B 47/024* (2013.01); *E21B 47/09* (2013.01); *E21B 47/12* (2013.01)

(58) Field of Classification Search
CPC ..... E21B 44/02; E21B 7/06; E21B 47/024; E21B 47/09; E21B 3/02; E21B 12/00; E21B 47/12
See application file for complete search history.

(56) References Cited

U.S. PATENT DOCUMENTS 3,725,777 A 4/1973 Robinson et al.
4,072,200 A 2/1978 Morris et al.
(Continued)

FOREIGN PATENT DOCUMENTS

EP 0366567 A2 5/1990
EP 0682269 A2 11/1995
(Continued)

OTHER PUBLICATIONS

PCT International Search Report and Written Opinion; PCT/US2018/063862; dated Mar. 27, 2019.
(Continued)

*Primary Examiner* — Yong-Suk (Philip) Ro
(74) *Attorney, Agent, or Firm* — Pramudji Law Group PLLC; Ari Pramudji

(57) ABSTRACT

Various implementations described herein refer to an apparatus having an instrument cluster with accelerometers and gyroscopic sensors. The apparatus may include a controller that communicates with the instrument cluster, receives measurement data from the accelerometers and the gyroscopic sensors, and acquires a computed tool orientation of a drilling tool based on the measurement data from the accelerometers and the gyroscopic sensors. The controller may generate tool steering commands for the drilling tool based on a difference between a planned tool orientation and the computed tool orientation.

20 Claims, 8 Drawing Sheets

(51) Int. Cl.

| | |
|---|---|
| ***E21B 47/12*** | (2012.01) |
| ***E21B 47/09*** | (2012.01) |
| ***E21B 47/024*** | (2006.01) |

(56) References Cited

U.S. PATENT DOCUMENTS

| | | | | |
|---|---|---|---|---|
| 4,791,373 | A | 12/1988 | Kuckes | |
| 5,258,755 | A | 11/1993 | Kuckes | |
| 5,432,699 | A | 7/1995 | Hache | |
| 5,485,089 | A | 1/1996 | Kuckes | |
| 5,623,407 | A | 4/1997 | Brooks | |
| 5,676,212 | A | 10/1997 | Kuckes | |
| RE36,569 | E | 2/2000 | Kuckes | |
| 6,092,610 | A | 7/2000 | Kosmala et al. | |
| 6,508,316 | B2 | 1/2003 | Estes et al. | |
| 6,529,834 | B1 | 3/2003 | Estes et al. | |
| 6,957,580 | B2 | 10/2005 | Ekseth et al. | |
| 6,985,814 | B2 | 1/2006 | McElhinney | |
| 7,510,027 | B2 | 3/2009 | Weston et al. | |
| 8,065,085 | B2 | 11/2011 | Ekseth et al. | |
| 8,095,317 | B2 | 1/2012 | Ekseth et al. | |
| 8,185,312 | B2 | 5/2012 | Ekseth et al. | |
| 8,393,413 | B2 | 3/2013 | Weston et al. | |
| 8,579,044 | B2 | 11/2013 | Allen et al. | |
| 9,464,482 | B1 * | 10/2016 | Bargach | E21B 41/0085 |
| 9,631,475 | B2 | 4/2017 | Ledroz et al. | |
| 2001/0041963 | A1 | 11/2001 | Estes et al. | |
| 2003/0236627 | A1 | 12/2003 | Estes | |
| 2004/0069721 | A1 | 4/2004 | Ingelman et al. | |
| 2007/0126426 | A1 | 6/2007 | Clark et al. | |
| 2008/0156485 | A1 | 7/2008 | Phillips et al. | |
| 2009/0090555 | A1 * | 4/2009 | Boone | E21B 44/02 175/45 |
| 2009/0178851 | A1 * | 7/2009 | Weston | E21B 7/04 175/45 |
| 2012/0024606 | A1 | 2/2012 | Pirovolou et al. | |
| 2012/0139530 | A1 | 6/2012 | McElhinney et al. | |
| 2012/0245850 | A1 | 9/2012 | Bang et al. | |
| 2013/0282290 | A1 | 10/2013 | Weston et al. | |
| 2014/0102795 | A1 | 4/2014 | VanSteenwyk | |
| 2014/0374159 | A1 | 12/2014 | McElhinney et al. | |
| 2015/0107903 | A1 * | 4/2015 | Sugiura | E21B 7/06 175/45 |
| 2016/0138381 | A1 | 5/2016 | Logan et al. | |
| 2016/0201449 | A1 | 7/2016 | Dirksen et al. | |
| 2017/0254190 | A1 * | 9/2017 | Jones | E21B 44/005 |
| 2018/0045033 | A1 | 2/2018 | Jeffryes | |
| 2018/0252088 | A1 * | 9/2018 | Tilley | E21B 21/10 |

FOREIGN PATENT DOCUMENTS

| | | | |
|---|---|---|---|
| EP | 0793000 | A2 | 9/1997 |
| EP | 2180349 | A2 | 4/2010 |
| WO | 9404938 | A2 | 3/1994 |
| WO | 2014105503 | A2 | 7/2014 |

OTHER PUBLICATIONS

PCT International Search Report and Written Opinion; PCT/US2018/037314; dated Sep. 11, 2018.

U.S. Appl. No. 16/006,791, filed Jun. 12, 2018, entitled "Gyro-Magnetic Wellbore Surveying."

U.S. Appl. No. 15/896,010, filed Feb. 13, 2018, entitled "Gyro-Magnetic Wellbore Surveying."

EPO Search and Examination Report; EP 14173737.9; dated May 17, 2016.

CIPO Office Action; CA 2,854,746; dated May 16, 2017.

CIPO Office Action; CA 2,854,746; dated Jul. 8, 2016.

Meeker, D., "Finite Element Method Magnetics," Version 4.2, User's Manual, found at http://www.femm.info/Archives/doc/manual42.pdf, 2010.

Lee, D., et al., "U-Tube Wells—Connecting Horizontal Wells End to End Case Study: Installation and Well Construction of the World's First U-Tube Well," SPE/IADC Drilling Conference 92685, pp. 1-12, Feb. 23-25, 2005.

Stockhausen, E.J. and Lesso, W.G., Jr., "Continuous Direction and Inclination Measurements Lead to an Improvement in Wellbore Positioning," SPE/IADC Conference 79917, pp. 1-16, Feb. 19-21, 2003.

Nekut, A.G., et al., "Rotation Magnet Ranging—A New Drilling Guidance Technology," 8th SPE, One Day Conference on Horizontal Well Technology, pp. 1-8, Nov. 7, 2001.

McElhinney, G., et al., "Case Histories Demonstrate a New Method for Well Avoidance and Relief Well Drilling," SPE/IAD Conference 37667, pp. 1-8, Mar. 4-6, 1997.

Sognees, R., et al., "Improving MWD Survey Accuracy in Deviated Wells by Use of a New Triaxial Magnetic Aximuth Correction Method," SPWLA 37th Annual Logging Symposium, pp. 1-14, Jun. 16-19, 1996.

Smirnov, B.M., "Method of Determining the Coordinates and Magnetic Moment of a Dipole Field Source," Izmeritel'naya Tekhnika, No. 6, pp. 601-604, Jun. 1990.

Bosum, W., et al., "A Gyro-Oriented 3-Component Borehole Magnetometer for Mineral Prospecting, with Examples of its Application", Geophysical Prospecting, 36, pp. 933-961, 1988.

Weston, et al.; New Gyro While Drilling Technology Delivers Accurate Azimuth and Real-Time Quality Control for All Well Trajectories; SPE Drilling & Completion; Sep. 2014.

Ekseth, et al.; High-Integrity Wellbore Surveying; SPE Drilling & Completion; pp. 438-447; Dec. 2010.

MacMillan, et al.; Confidence Limits Associated with values of the Earth's Magnetic Field Used for Direction Drilling; SPE Drilling & Completion; Jun. 2010.

Thorogood, et al; Surveying Techniques with a Solid State Magnetic Multishoot Device SPE Drilling Engineering; Sep. 1990.

* cited by examiner

STEERING CONTROL OF A DRILLING TOOL

CROSS-REFERENCE TO RELATED APPLICATIONS

This application claims priority to and the benefit of U.S. Provisional Application No. 62/594,462, entitled "ENHANCED DIRECTIONAL DRILLING AND WELLBORE TRAJECTORY CONTROL", filed Dec. 4, 2017, which is incorporated herein by reference in its entirety.

This application is related to U.S. patent application Ser. No. 15/896,010, entitled "GYRO-MAGNETIC WELLBORE SURVEYING", filed Feb. 13, 2018, which is incorporated herein by reference in its entirety.

This application is related to U.S. patent application Ser. No. 14/301,123, entitled "POSITIONING TECHNIQUES IN MULTI-WELL ENVIRONMENTS", filed Jun. 10, 2014, which is incorporated herein by reference in its entirety.

BACKGROUND

This section is intended to provide information relevant to understanding the various technologies described herein. As the section's title implies, this is a discussion of related art that should in no way imply that it is prior art. Generally, related art may or may not be considered prior art. It should therefore be understood that any statement in this section should be read in this light, and not as any admission of prior art.

While drilling a wellbore, directional survey data should be obtained as close as possible to a drill bit to thereby control more precisely a drill path of the wellbore that is under construction. Accuracy of conventional near-bit measurements has been limited for a number of reasons. Some limitations of conventional systems occur due to at least vibration and shock environment to which sensors are subjected, spatial limitations and magnetic interference. In some conventional bent-sub drilling, accelerometers have been deployed to provide near-bit inclination. However, the measurement of azimuth has been derived from magnetic measurement while drilling (MWD) or gyro while drilling (GWD) tools that have been located some distance above the drill bit.

SUMMARY

Described herein are various implementations of an apparatus. The apparatus may include an instrument cluster with accelerometers and gyroscopic sensors. The apparatus may include a controller that communicates with the instrument cluster, receives measurement data from the accelerometers and the gyroscopic sensors, and acquires a computed tool orientation of a drilling tool based on the measurement data from the accelerometers and the gyroscopic sensors. The controller may generate tool steering commands for the drilling tool based on a difference between a planned tool orientation and the computed tool orientation.

Described herein are various implementations of an apparatus. The apparatus may include an instrument cluster having gyroscopic sensors. The apparatus may include a controller that communicates with the instrument cluster, receives gyroscopic measurement data from the gyroscopic sensors, and continuously acquires a computed tool orientation of a drilling tool based on the gyroscopic measurement data received from the gyroscopic sensors. The controller may generate steering commands for actively guiding the drilling tool along a guided drilling trajectory based on a deviation of the computed tool orientation of the drilling tool from a planned drilling trajectory.

Described herein are various implementations of a method. The method may include acquiring static measurement data from sensors in a drilling tool during a static mode of operating the drilling tool. The static measurement data may include one or more of static gyroscopic measurement data, static accelerometer measurement data, and static magnetometer measurement data. The method may include acquiring continuous dynamic measurement data from the sensors in the drilling tool during a dynamic mode of operating the drilling tool. The continuous dynamic measurement data may include one or more of continuous dynamic gyroscopic measurement data, continuous dynamic accelerometer measurement data, and continuous dynamic magnetometer measurement data. The method may include acquiring a computed tool orientation for the drilling tool during the static mode of operating the drilling tool and the continuous mode of operating the drilling tool based on the static measurement data and the continuous dynamic measurement data. The method may include comparing the computed tool orientation to a planned tool orientation. The method may include generating tool steering commands for guiding the drilling tool based on a deviation of the computed tool orientation from a planned trajectory of the drilling tool that is derived from the planned tool orientation.

The above referenced summary section is provided to introduce a selection of concepts in a simplified form that are further described below in the detailed description section. Additional concepts and various other implementations are also described in the detailed description. The summary is not intended to identify key features or essential features of the claimed subject matter, nor is it intended to be used to limit the scope of the claimed subject matter, nor is it intended to limit the number of inventions described herein. Furthermore, the claimed subject matter is not limited to implementations that solve any or all disadvantages noted in any part of this disclosure.

BRIEF DESCRIPTION OF THE DRAWINGS

Implementations of various techniques are described herein with reference to the accompanying drawings. It should be understood, however, that the accompanying drawings illustrate only various implementations described herein and are not meant to limit embodiments of various techniques described herein.

DETAILED DESCRIPTION

Various implementations described herein are directed to sensor integration for enhanced steering control of a drilling tool. For instance, various schemes and techniques described herein are related to incorporating gyroscopic sensors within a rotary steerable system (RSS) drilling tool to provide enhanced directional drilling and associated data close to a drill bit of the RSS drilling tool. The various implementations described herein may provide for more precise measurements of wellbore direction so as to allow enhanced trajectory control in accordance with a planned well path. The various implementations described herein may further deploy gyroscopic sensors along with accelerometers and magnetometers so as to achieve near-bit azimuth data (i.e., near the drill bit) in real time during a drilling process. In some implementations, gyroscopic sensor data may be used directly or in combination with magnetometer data and/or accelerometer data deployed in RSS drilling tools to determine near-bit azimuth with greater precision.

Various implementations of sensor integration for enhanced steering control of a drilling tool will now be described in herein with reference to FIGS. 1A-8.

Figure 1A:
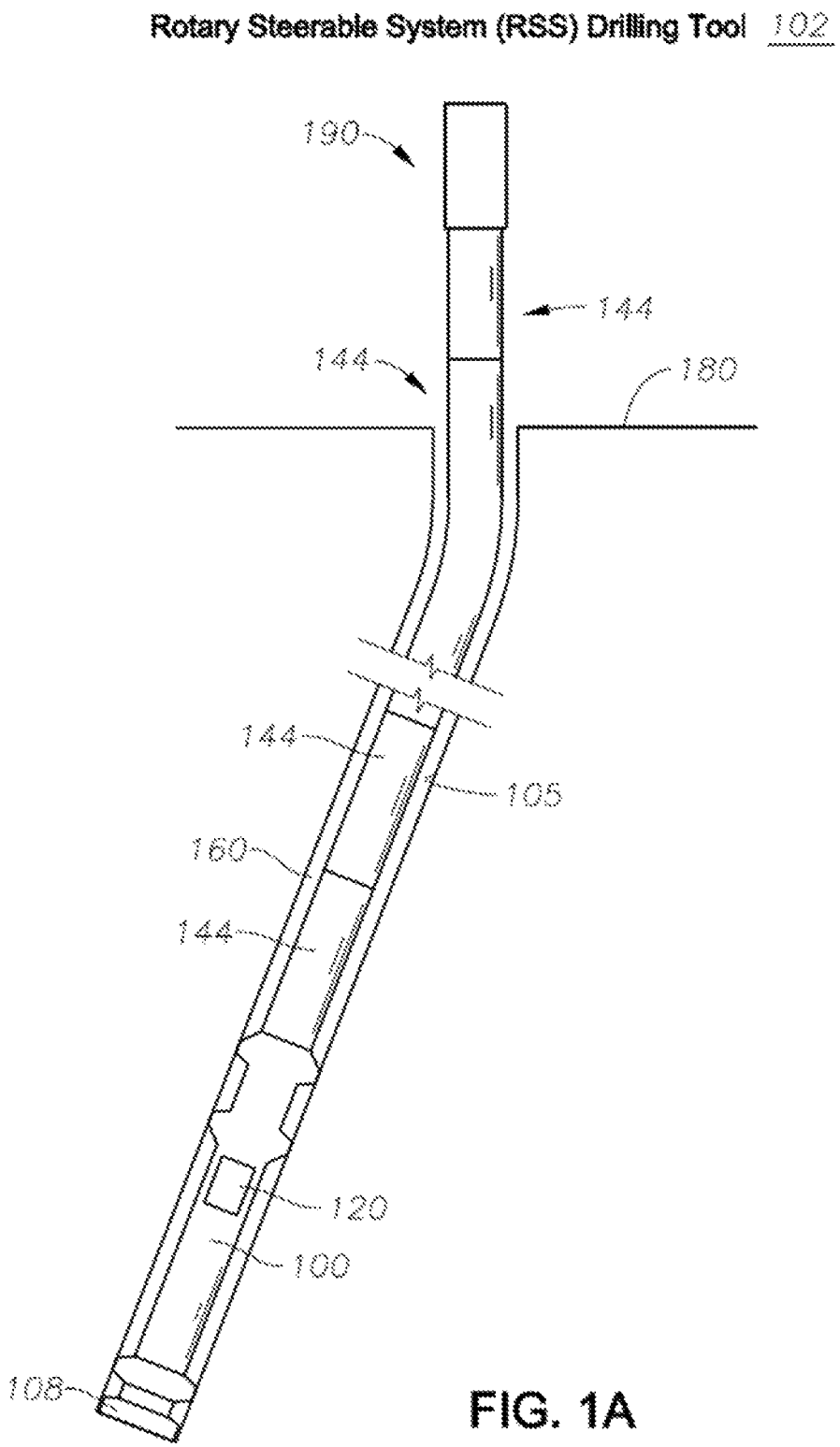
FIGS. 1A-1B illustrate diagrams of a drilling tool in accordance with various implementations described herein.
Figure 1B:
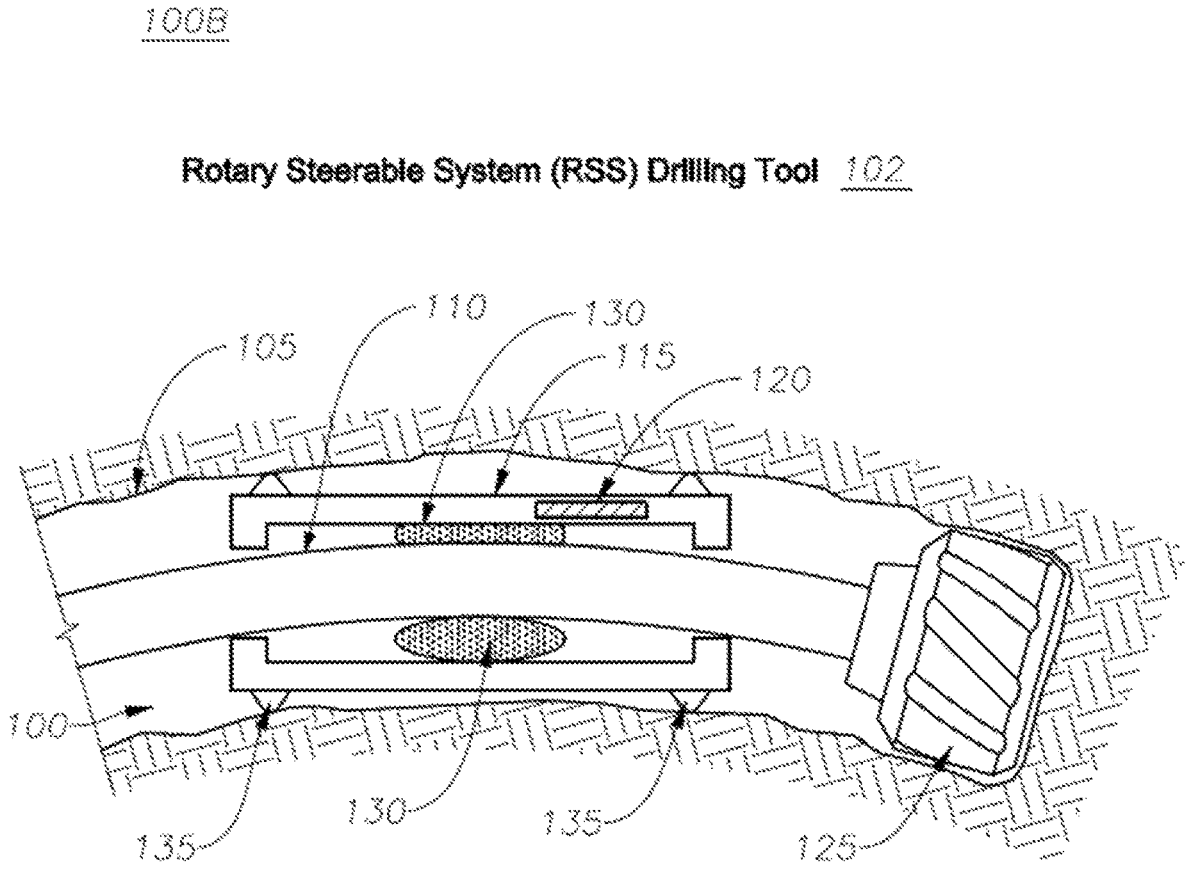

FIGS. 1A-1B illustrate some diagrams of a drilling tool 100 in accordance with various implementations described herein. In particular, FIG. 1A illustrates the drilling tool 100 when inserted into a wellbore 105 that is being surveyed, and FIG. 1B illustrates integration of sensors 120 for enhanced steering control of the drilling tool 100.

In FIG. 1A, directional sensors 120 may form part of an instrumentation pack or cluster, such as, e.g., a measurement-while-drilling (MWD) or logging-while-drilling (LWD) instrumentation pack. The one or more directional sensors 120 may be disposed on another portion of the drill string, such as, e.g., on section 144 of drill string above the drilling tool 100. For instance, FIG. 1A illustrates a diagram of a drill string 160 disposed within a wellbore 105 in accordance with various implementations described herein. The drill sting 160 may include the drilling tool 100 with directional sensors 120 and one or more pipe segments 144 extending to a surface 180 (e.g., the Earth's surface). In some implementations, the remainder of the one or more pipe segments 144 may extend to the Earth's surface 180 in a daisy-chained configuration.

In some implementations, a computing system 190 (e.g., a controller or other computing device having a processor) may be included in the drill string 160, and the computing system 190 may be configured to control and/or monitor operation of the drill string 160 or various portions thereof. The computing system 190 may be configured to perform a variety of functions. For instance, the computing system 190 may be adapted to determine a current orientation or a trajectory of the drilling tool 100 within the borehole 105. The computing system 190 may also include a memory subsystem adapted to store appropriate information, such as orientation data, data obtained from one or more sensors disposed on the drill string 160, and/or similar. The computing system 190 may include hardware, software, or some combination thereof. For instance, the computing system 190 may include one or more processors or a standard computer.

In some implementations, the computing system 190 may provide a real-time processing analysis of the signals or data obtained from various sensors within the tool 100. For instance, data obtained from various sensors of the tool 100 may be analyzed while the tool 100 travels within the wellbore 105. In some instances, at least a portion of data obtained from the various sensors is stored in memory for analysis by the computing system 190. Also, the computing system 190 may include sufficient data processing and data storage capacity to perform the real-time analysis.

As described herein, the steering subsystem 112 may be configured, as drilling proceeds, to angulate a shaft so as to change or maintain a current wellbore course. The current wellbore course may be defined in terms of an inclination and an azimuth of the wellbore, tool-face angle of the tool 100, and/or by dogleg severity of the wellbore 105. In some instances, the steering subsystem 112 may be configured to change or maintain a current wellbore course associated with a preprogrammed course, trajectory or directional commands. For instance, an operator may input a preprogrammed course into a terminal, such as, e.g., a computer terminal positioned above ground near the surface 180 (e.g., a terminal coupled to the computing system 190 or to an on-board computing system of the tool 100), prior to deployment of the tool 100. In other instances, the operator may input directional commands into the terminal during drilling. In some instances, a combination of a preprogrammed course, trajectory and/or real-time directional commands may also be used to steer the tool 100.

In some implementations, the drill string 160 may include one or more additional controllers instead of, or in addition to, the computing system 190. For instance, the one or more additional controllers (or other computing system) may be located at or above the Earth's surface 180. In other instances, one or more additional controllers may be located within a downhole portion of the drill string 160. In other instances, the drilling tool 100 may include an on-board computing system (not shown).

In some implementations, the computing system 190 may be disposed at or above the Earth's surface 180, and the computing system 190 may be communicatively coupled to the on-board computing system. For instance, the downhole portion of the drill string 160 may be part of a borehole drilling system capable of measurement MWD or LWD. Signals from the downhole portion may be transmitted by mud pulse telemetry or electromagnetic (EM) telemetry to the computing system 190. In some implementations, where at least a portion of the computing system 190 is located at or above the Earth's surface 180, the computing system 190 may be coupled to the downhole portion (e.g., the on-board computing system, the sensors located within the downhole portion, and/or the like) within the wellbore 105 by wire or cable extending along the drill string 160. In some instances, the drill string 160 may include signal conduits through which the signals are transmitted from the downhole portion of the drill string 160 (e.g., transmitted from the on-board computing system or from sensors disposed within the downhole portion) to the computing system 190. In this instance, the drill string 160 is adapted to transmit control signals from the computing system to the downhole portion of the drill string 160.

The on-board computing system of the tool 210 may also store information related to the drilling tool 100, operation of the drilling tool 100, and similar. For instance, the computing system may store information related to the target drilling course, current drilling course, tool configuration, tool components, and similar. The on-board computing system and/or one or more directional sensors 120 may be within a nominally non-rotating section of the drilling tool 100 (e.g., within housing 104). In some instances, the computing system and/or one or more directional sensors 120 may be disposed elsewhere, such as, e.g., within a rotating section of the tool 100, or at some other location within the wellbore 105 (e.g., on some other portion of the drill string 160). In other instances, measurement-while-drilling (MWD) (not shown) instrumentation pack or cluster, including one or more directional sensors 120, may be mounted on the downhole portion of the drill string 160 at some location above the drilling tool 100.

While various implementations of the RSS drilling tool 100 are discussed above with respect to FIG. 1A, those skilled in the art know that other implementations of RSS drilling tools may be used as well.

Using high inclination GWD tools, various methods described herein are able to establish a definitive survey in real-time during drilling. In other implementations, the GWD sensor(s) may be run at a same time as the magnetic MWD sensor(s), and the measurements may be combined in some manner as outlined in the following paragraph (e.g., by averaging the two surveys or by using the gyroscopic sensor data to correct the MWD survey) and compared against one another for quality control (QC) purposes.

In some instances, combination of multiple surveys with a weighted averaging process may result in enhanced confidence in a resulting survey and a reduction in survey error uncertainty. In situations where two surveys are combined and one is known to be of significantly greater precision than the other, the higher accuracy survey may be treated as a reference, and measurement differences between the two sets of data may be used to form estimates of the errors in the lower quality survey. These estimates may then be used to correct a lower grade system. This situation may arise, e.g., during a process of creating a well using MWD and GWD survey tools, particularly when using a basic MWD approach, e.g., in absence of in-field referencing (IFR) techniques. It is noted that MWD refers to a method for controlling direction of a well during the drilling process, with GWD being used in regions of suspected magnetic interference.

To date, high precision gyroscopic surveys have been based on application of mechanical spinning wheel gyroscopic sensors. Such instruments are subject to a variety of error sources, including gravity dependent errors resulting from mass unbalance and other imperfections within the sensor. Careful calibration and on-line correction methods allow maintaining such effects to be contained to within acceptable levels. Relatively new sensor technology, such as, e.g., Coriolis vibratory gyros (CVGs) and micro-electro mechanical sensors (MEMS), have been developed to achieve a level of performance comparable with other mechanical gyros used in oilfield applications. Such instruments may be less susceptible to gravity-dependent effects, making them easier to use without concern over the effect that gravity-dependent errors may be having on survey accuracy. It may thus be realized to use a CVG gyro survey as a reference allowing MWD magnetic surveys errors to be estimated and corrected. Survey data is generated and transmitted to the surface 180 so as to allow a directional driller to control wellbore trajectory and/or use the drilling tool 100 as part of an automated well trajectory control process.

FIG. 1B illustrates the downhole drilling tool 100 as a rotary steerable system (RSS) drilling tool. The drilling tool 100 includes a non-rotating outer case 115, a drill bit 125 that is coupled to a rotating drill shaft 110, a steering mechanism 130 that is engaged with the rotating drill shaft 110, and one or more spacers 135. The drilling tool 100 is a type of directional drilling tool that allows for directional drilling of boreholes while allowing or maintaining rotation of the drill string. The directional drilling tool 100 described herein may be referred to as a point-the-bit system. In some instances, various other types of rotary steerable tools may use different steering mechanisms. For instance, push-the-bit systems may be used in which a force is applied against a wall of the wellbore to cause the bit to push in an opposite direction. Other systems may use a continuous proportional steering system that is implemented with hydraulically operated pads mounted on a slowly rotating sleeve to achieve the required bit direction. In these systems, part of the drilling tool is in contact with the wall of the wellbore and is thus not subjected to severe shock and vibration during the drilling process.

The techniques described herein may provide for improved directional control, improved hole cleaning, and/or improved borehole quality. The schemes and techniques described herein may also be used to reduce or minimize drilling problems as compared to conventional tools. In some cases, such tools may include steering mechanisms 130 that cause bit direction to change relative to the outer casing to enable controlled changes in borehole direction to take place. Also, in some rotary tools of this type, the sensors (e.g., sensors as part of directional survey instrumentation 120) that provide directional data are installed in an outer casing 115, which may be constrained from moving by pads or spacers, e.g., spacers 135, that are continuously in contact with an inner wall of the wellbore 105. In this instance, directional instruments may not be subjected to severe shock and vibration environment that is normally expected while drilling. However, space available to accommodate measurement sensors in such tools is severely restricted and has, as a consequence, restricted the type of sensors deployed.

While some accelerometers and magnetometers are sufficiently small enough to be installed in an outer casing of the drilling tool 100, suitably sized gyroscopic sensors of adequate performance have not been available. However, some recent developments in solid state sensor technology have provided the ability to develop high performance gyroscopic devices that are capable for deployment within the outer casing of the drilling tool 100. For instance, various Coriolis-type vibratory gyro (CVGs) sensors include some micro-electro-mechanical system (MEMS) sensors that are suited for inclusion in the downhole drilling tool 100 because they are substantially rugged and are able to withstand high levels of shock and vibration, and such sensors are unaffected by magnetic interference. In contrast, magnetic sensors are affected by magnetic interference arising as a consequence of being mounted in close proximity to the drill bit 125, which may be a result of magnetic material used within the rotary steerable tool structure, and which may also be a result of external magnetic interference that may be present when drilling in close proximity to other wellbores. Given the possibility of installing gyros in a rotary steerable drilling tool, alongside accelerometers and magnetometers, there are various ways in which available measurements may be used.

In some instances, for survey tools used while drilling, it has been customary to take directional survey measurements at drill pipe connections when the sensors are stationary. For RSS tools, where the mechanical environment is more benign, surveys based on RSS instrumentation are taken more frequently (e.g., every minute) to check that the planned programmed trajectory is being followed. Essentially, it is this information that controls the steering mechanism within the tool while drilling. In addition, the use of gyros also allows survey measurements to be taken during the drilling process, e.g., on a continuous basis, so as to enhance quality and frequency of the tool steering information. Stationary measurements may be taken using gyros, magnetometers, or a combination thereof at pipe connections when the drilling tool 100 is stationary. Such measurements may be used to initialize the continuous measurement process at the start of a drilled section and/or to re-initialize the process at each pipe connection. It should be noted that the availability of the two partially independent measurements of azimuth afforded by sensor instrumentation 120 may have an added benefit of providing a gross error check on respective measurements. Differences in azimuth angles computed using different sensor measurements that exceed a pre-defined tolerance may indicate that one or both sources of measurement is in error. Acceptable tolerances are defined based on respective error models for the two types of measurement. However, it is also important to note that magnetometer measurements are affected by magnetic material in the vicinity of the wellbore when under construction and during drilling, while gyros are not be susceptible to magnetic interference. As such, it may be preferable to use the gyro measurements alone. Methods of using of gyroscopic data for generating both stationary and continuous measurements in an RSS drilling tool are described herein.

Figure 2:
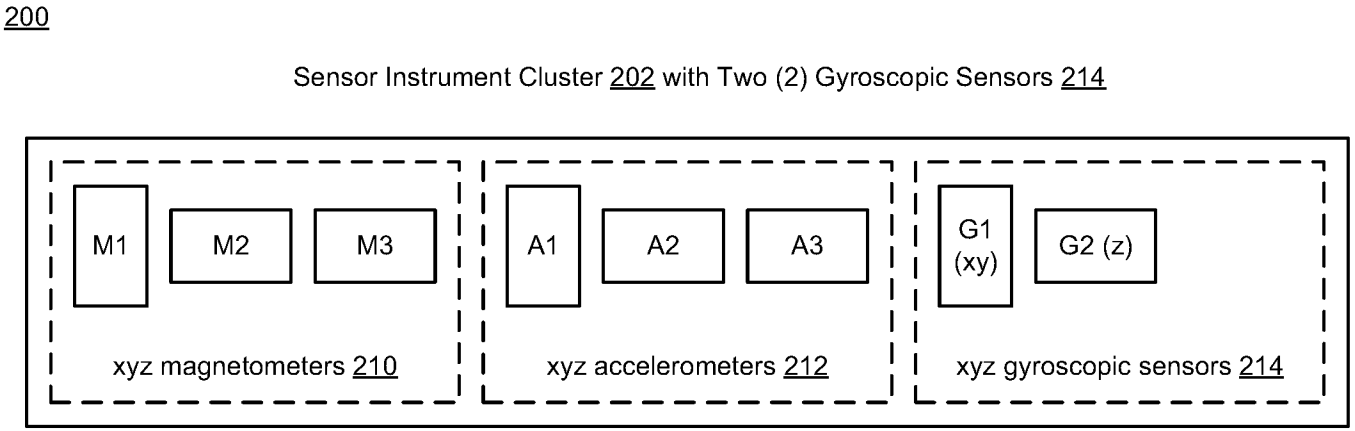
FIGS. 2-3 illustrate diagrams of a sensor instrument cluster having gyroscopic sensors in accordance with various implementations described herein.
Figure 3:
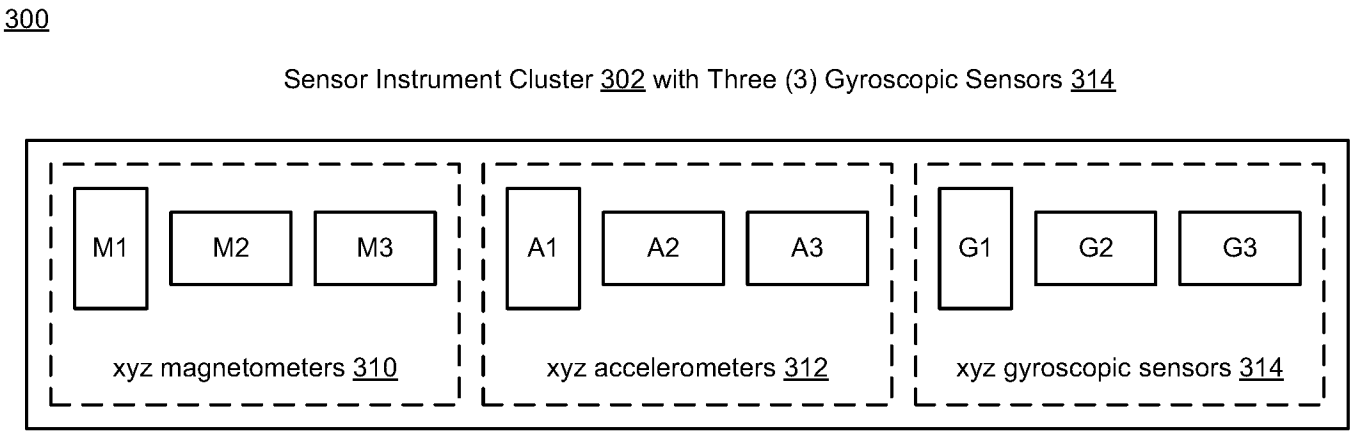

FIGS. 2-3 illustrate diagrams 200, 300 of sensor instrument clusters 202, 302 having gyroscopic sensors 214, 314 in accordance with some implementations described herein. In particular, FIG. 2 illustrates a diagram 200 of a sensor instrument cluster 202 having two gyroscopic sensors 214, and FIG. 3 illustrates a diagram 300 of another sensor instrument cluster 302 having three gyroscopic sensors 314.

As shown in FIG. 2, the sensor instrument cluster 202 has multiple sensors, including, e.g., multiple magnetometers 210, multiple accelerometers 212, and multiple gyroscopic sensors 214. In some instances, the multiple magnetometers 210 may include three (3) magnetometers (M1, M2, M3) that are arranged and configured for x, y, and z axes with respect to the tool. In addition, the multiple accelerometers 212 may include three (3) accelerometers (A1, A2, A3) that are arranged and configured for x, y, and z axes with respect to the tool. Also, the multiple gyroscopic sensors 214 may include two (2) gyroscopic sensors (G1, G2), which may refer to two dual-axis gyros, e.g., an xy-gyro and a z-gyro, respectively.

As shown in FIG. 3, the sensor instrument cluster 302 has multiple sensors, including, e.g., multiple magnetometers 210, multiple accelerometers 212, and multiple gyroscopic sensors 214. In some instances, the multiple magnetometers 210 may include three (3) magnetometers (M1, M2, M3) that are arranged and configured for x, y, and z axes with respect to the tool. In addition, the multiple accelerometers 212 may include three (3) accelerometers (A1, A2, A3) that are arranged and configured for x, y, and z axes with respect to the tool. Also, the multiple gyroscopic sensors 214 may include three (3) single-axis gyroscopic sensors (G1, G2, G3) that are arranged and configured for x, y, and z axes with respect to the tool.

Generally, the sensors (e.g., gyros and accelerometers) are usually mounted to generate measurements about three orthogonal axes (x, y and z), and the sensors are nominally aligned with the xyz axes of the tool. GWD systems that use spinning mass gyroscopes include two dual-axis gyros (to provide x, y and z measurements along with a redundant measurement for operation at any orientation) or a single dual-axis gyro (to provide x and y measurement only and operates at inclinations up to 70° only). For gyros used in RSS tools, spinning mass gyros may be substantially large in size and may not be used in some situations. Hence, for RSS tools, CVGs or MEMS gyros may be used for attitude capability, and therefore, RSS tools may be used in various xyz (G1, G2, G3) configurations.

Stationary Data

At drill pipe connections, when the RSS tool 100 is stationary, the gyroscopic sensors may provide measurements of the components of Earth's rate along its sensitive axis. If desired, due to different circumstances, stationary surveys may be taken at any point of the drilling process. Depending on trajectory of the well, two gyros (FIG. 2) or three gyros (FIG. 3) may be deployed in the drilling tool 100. As described herein above, FIG. 2 illustrates an implementation with two gyroscopic sensors (G1, G2), and FIG. 3 illustrates another implementation with three gyroscopic sensors (G1, G2, G3). In some instances, three gyroscopic instruments, e.g., gyroscopic sensors (G1, G2, G3), may be utilized for high inclination wellbores, e.g., >70°. These gyroscopic measurements, in combination with three accelerometer measurements of the specific force due to gravity, allow estimates of tool azimuth (A) to be generated using a gyro-compassing process at any orientation of the tool. As shown herein below, the following equations may be implemented for this purpose.

For a two axis gyro system:

$$A = \arctan\left[\frac{(\omega_x\cos\alpha - \omega_y\sin\alpha)\cos I}{\omega_x\sin\alpha + \omega_y\cos\alpha - \Omega\sin\phi\sin I}\right] \tag{1}$$

For a three axis gyro system:

$$A = \arctan\left[\frac{\omega_x\cos\alpha - \omega_y\sin\alpha}{(\omega_x\sin\alpha + \omega_y\cos\alpha)\cos I + \omega_z\sin I}\right] \tag{2}$$

where $\omega_x\omega_y$=lateral (x and y) gyro measurements $\omega_z$=longitudinal (z) gyro measurement $$\alpha = \arctan\left[\frac{-g_x}{-g_y}\right], \text{ tool-face angle} \tag{3}$$

$$I = \arctan\left[\frac{\sqrt{g_x^2 + g_y^2}}{g_z}\right], \text{ inclination} \tag{4}$$

$g_x$, $g_y$, $g_z$=accelerometer measurements

An alternative approach refers to combining the gyroscopic and magnetometer measurements. This technique may involve generation of a weighted average of the two, partially independent, estimates of azimuth angle provided by gyroscopic and magnetic instruments. The weighting factors may be based on respective error and/or instrument performance models defined for the two types of system.

Another alternative approach refers to events where the gyroscopic sensors are subject to significant levels of shock and/or vibration. In this instance, this technique may use the gyroscopic measurements taken while stationary to verify acceptability of the magnetic measurements used throughout the drilling process. Also, this technique may compare results and then make adjustments to magnetic readings as appropriate.

A more rigorous approach may be implemented by combining the gyroscopic and magnetic measurements using a statistical estimation procedure. Given knowledge of the sources of error in magnetic and gyroscopic systems, and the manner in which they propagate (e.g., based on published instrument performance models) and also assuming proper quality control methods are adhered to and satisfied, the error estimation process proposed may be achieved using statistical estimation techniques, such as, e.g., with a least squares estimation or with Kalman filtering methods.

For reference, related U.S. patent application Ser. No. 15/896,010, entitled "GYRO-MAGNETIC WELLBORE SURVEYING", filed Feb. 13, 2018, is incorporated herein by reference in its entirety. With this reference, the following describes one implementation of an example system, wherein magnetic and gyroscopic system measurements of azimuth may be compared. Based on knowledge of how various error sources propagate as survey error, a least squares estimation (LSE) of these errors may be computed. This is accomplished by collecting survey readings over a number of survey stations, and performing the least squares calculation. In some implementations, the number of survey stations may be 5 or more. The error estimates are then applied as corrections to the magnetic and gyroscopic survey data as drilling proceeds in the subsequent well section. The effectiveness of the method in calculating the errors correctly is monitored by observing the expected reduction in the azimuth measurement differences, the variances of errors and correlation coefficients, all of which may be generated as part of the least squares process.

In some instances, the method outlined above may be conducted using the LSE method based on a fixed number of readings before advancing to the next station and repeating the method using the same number of readings. In other instances, the Kalman method could be used, as described herein below. For instance, in one implementation, readings from a new station may be included and the readings from the initial station may be removed from the first set of readings. Therefore, having collected the first set of readings to initiate the method, the estimation calculation may be repeated at each station thereafter. This approach has the additional advantage of filtering (smoothing) noisy measurements generated by the magnetic sensor system or the gyroscopic sensor system.

In the LSE method, the actual magnetometer measurements may be compared with estimates of the magnetometer measurements derived using the gyroscopic measurements and magnetic field data including a current estimate of declination.

The magnetometer readings may be denoted ($\tilde{b}_x$, $\tilde{b}_y$, $\tilde{b}_z$), and estimates of these quantities ($\hat{b}_x$, $\hat{b}_y$, $\hat{b}_z$) may be derived based on knowledge of the total Earth's magnetic field ($b_T$), dip ($\theta$), and declination (D):

$$\hat{b}_x = b_T[\cos\theta\cos(A-D)\cos I - \sin\theta\sin I]\sin TF + b_T\cos\theta\sin(A-D)\cos TF$$

$$\hat{b}_y = b_T[\cos\theta\cos(A-D)\cos I - \sin\theta\sin I]\cos TF + b_T\cos\theta\sin(A-D)\sin TF$$

$$\hat{b}_z = b_T[\cos\theta\cos(A-D)\sin I - \sin\theta\cos I],$$

where A, I and TF represent true azimuth (derived from the gyro measurements) and the inclination and tool face angles (derived from the accelerometer measurements respectively.

The least squares estimation (LSE) process is designed to generate estimates of the declination error, the magnetometer biases and scale factor errors, all of which may constitute an error state estimation vector for the purposes of this example mechanisation, and is denoted by $\Delta X$.

The measurement differences, $$\Delta Y = \begin{bmatrix} \hat{b}_x - \tilde{b}_x \\ \hat{b}_y - \tilde{b}_y \\ \hat{b}_z - \tilde{b}_z \end{bmatrix}$$

form inputs to the least squares estimator, and is based on a measurement error model which may expressed in terms of the following matrix equation: $\Delta Y = H\,\Delta X$, where H relates the measurement differences to the error states, which may be referred to as the design matrix, and is formed from the partial derivatives of the measurement equation.

The least squares estimates of the error states are generated using:

$$\Delta X = [H^T H]^{-1} H^T \Delta Y$$

The covariance of the error estimates (P), which may be monitored to check that the estimation process converges over successive iterations, is formed as follows:

$$P = \sigma_0^2 [H^T H]^{-1}$$

where $$\sigma_0^2 = \frac{[A\widehat{\Delta X} - \Delta Y]^T \cdot [A\widehat{\Delta X} - \Delta Y]}{m - s}$$

in which m=number of measurements, s=number of states. $\widehat{\Delta X}$ is the best estimate of the errors.

An iterative estimation process based on a Kalman filtering method offers an alternative approach, which is described in more detail herein below. In this case, each set of survey readings may be processed in turn as drilling proceeds, and the current estimates of the errors are used to correct the magnetic readings.

The measurement differences ($\Delta Y$) described herein above form inputs to the Kalman filter, which again is based on an error model of the system, defined by the design matrix H. The expected errors in error states ($\Delta X$) are used to initialise an error covariance matrix (P), which is used within the filter to apportion measurement differences between the respective error estimates and the expected levels of measurement noise.

In some instances, Kalman filtering may be implemented in two stages so as to be in accordance with standard procedure. At each survey station, a prediction step takes place followed by a measurement update step in which the latest set of measurements may be incorporated into the calculation so as to update the error estimates. The filter equations are provided herein below.

The covariance matrix corresponding to the uncertainty in the predicted state vector in certain implementations is given by:

$$P_{k/k-1} = P_{k-1/k-1} + Q$$

where $P_{k/k-1}$ is the covariance matrix at station k predicted at station k−1, e.g., a covariance matrix prior to the update using magnetometer measurements at station k. Since there are no dynamics associated with error terms considered here, the prediction step may involve an update to an error covariance matrix through addition of a noise term (Q), which represents the expected random uncertainty in the error terms.

In some implementations, the covariance matrix and state vector are updated, following a measurement at station k, using the following equations:

$$P_{k/k} = P_{k/k-1} - G_k H_k P_{k/k-1}$$

and $$X_{k/k} = X_{k/k-1} - G_k \Delta Y_k$$

where $P_{k/k}$ is the covariance matrix following the measurement update at station k, $X_{k/k-1}$ is the predicted state vector, and $X_{k/k}$ is the state vector following the measurement update. The gain matrix $G_k$ is given by:

$$G_k = P_{k/k-1} H_k^T [H_k P_{k/k-1} H_k^T + R_k]^{-1}$$

where $R_k$ represents the noise in the measurement differences.

The success of the method in generating separate estimates of the individual errors will depend to some extent on wellbore geometry and the rotation of the survey tools within the well. The methods described herein may be implemented in a downhole processor (or controller) in real-time as part of the well construction process.

Continuous Data

During continuous periods of operation, the drilling tool keeps track of attitude (tool face, inclination and azimuth) using the integrated outputs of the gyroscopic sensors. For a system having x, y and z gyroscopic sensors, this technique may be achieved by solving the following set of differential equations to provide estimates of tool face (α), inclination (I), and azimuth (A) angles directly.

$$\dot{\alpha} = \omega_z + (\omega_x \sin\alpha + \omega_y \cos\alpha)\cot I - \frac{\Omega_H \cos A}{\sin I} \quad (5)$$

$$\dot{I} = -\omega_x \cos\alpha + \omega_y \sin\alpha + \Omega_H \sin A \quad (6)$$

$$\dot{A} = \frac{(\omega_x \sin\alpha + \omega_y \cos\alpha)}{\sin I} + \Omega_H \cos A \cot I - \Omega_V \quad (7)$$

where $\omega_x$ and $\omega_y$ refer to measurements of angular rate about the x and y axes, respectively, of the survey tool, while $\Omega_H$ and $\Omega_V$ refer to the horizontal and vertical components of the Earth's turn rate; calculated at the known latitude of the well. For systems incorporating x and y gyroscopic sensors only (e.g., FIG. 2), inclination and azimuth may be calculated directly using equations (6) and (7) while tool-face angle may be computed using x and y accelerometer measurements via equation (3).

In some instances, the integration process may be initialized using the attitude data generated by stationary measurements, and the stationary measurements may be generated by the magnetometers, the gyroscopic sensors, or a combination of the two, as described herein above.

Figure 4:
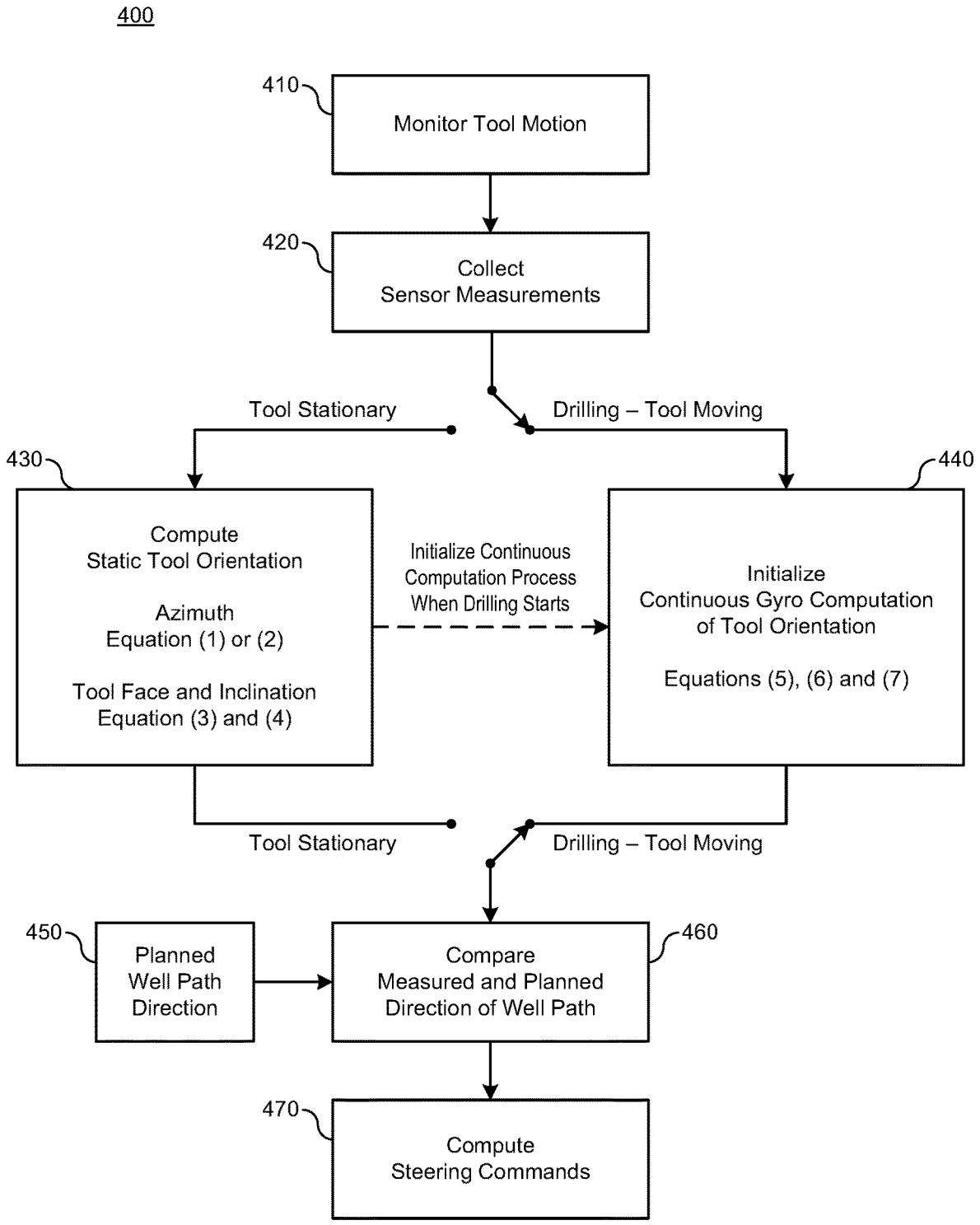
FIGS. 4-5 illustrate diagrams of sensor integration process in accordance with various implementations described herein.
Figure 5:
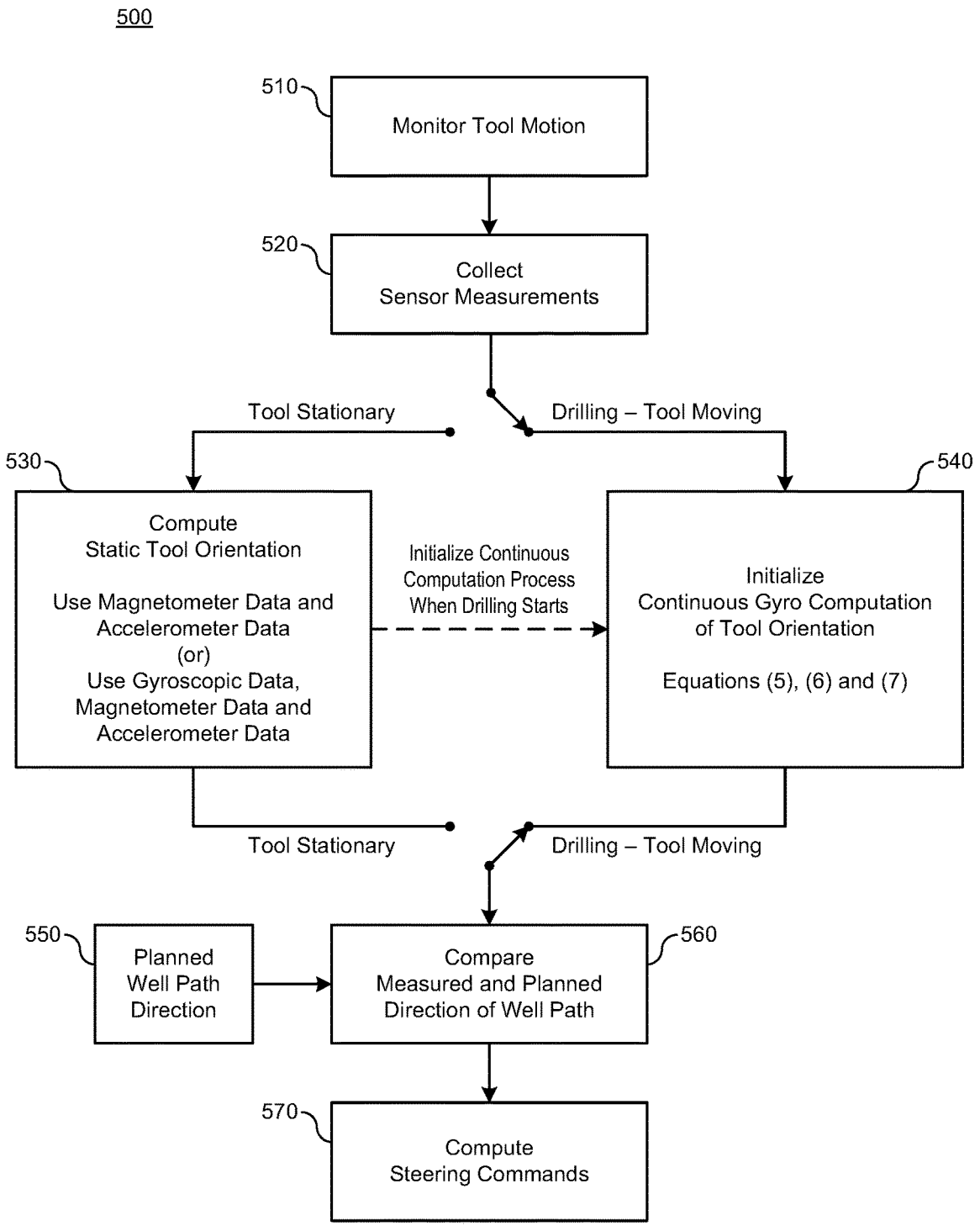

FIGS. 4-5 illustrate various diagrams of sensor integration processes 400, 500 in accordance with implementations described herein. In particular, FIG. 4 illustrates a diagram of sensor integration process 400, and FIG. 5 illustrates a diagram of another sensor integration process 500.

FIG. 4 illustrates a process flow diagram of a method 400 for implementing sensor integration in accordance with implementations described herein.

It should be understood that even though method 400 may indicate a particular order of operation execution, in some cases, various certain portions of the operations may be executed in a different order, and on different systems. In other cases, additional operations and/or steps may be added to and/or omitted from method 400. Method 400 may be implemented as a program or software instruction process that may be used for implementing sensor integration for enhanced steering control of a downhole drilling tool as described herein. Also, if implemented in software, various instructions related to implementing method 400 may be stored in memory and/or a database. For instance, a computer or various other types of computing devices (e.g., computer system 600 shown in FIG. 6) having a processor (or controller) and memory may be configured to perform method 400 in accordance with schemes and techniques described herein.

At block 410, method 400 may monitor tool motion, and at block 420, method 400 may collect sensor measurements. When the downhole drilling tool is stationary, at block 430, method 400 may compute static tool orientation. In this instance, azimuth (e.g., along z-axis) of the tool may be computed with equation (1) or equation (2). Also, tool-face and inclination of the tool may be computed with equation (3) and equation (4).

In some implementations, initializing a continuous computation process may be achieved when drilling starts. When the downhole drilling tool is moving, at block 440, method 400 may initialize continuous gyroscopic computation of tool orientation, which may refer to computing dynamic tool orientation during downhole drilling. In this instance, the continuous gyroscopic computation of tool orientation may be computed with one or more of equations (5), (6), and (7).

At block 450, a planned well path direction may be provided, and at block 460, method 400 may compare a measured (or computed) direction of the well path with the planned direction of the well path. Also, at block 470, method 400 may compute steering commands for controlling the drilling trajectory of the downhole drilling tool.

In reference to FIG. 4, steering commands are generated for the downhole drilling tool, which may be implemented with an RSS drilling tool. Some measurements of acceleration and angular rate are provided by accelerometers and gyroscopic sensors, respectively. When drilling ceases and the tool is stationary, its azimuth angle is computed using equation (1) or equation (2), for the two and three axis gyroscopic mechanizations, respectively. In some instances, as described above, tool-face and inclination angles may be computed using equations (3) and (4). When drilling recommences, these angles are used to initialize a continuous data processing algorithm, and the continuous computation process described by equations (5), (6) and (7), may be implemented. The resulting tool orientation data may be compared with planned trajectory data at an appropriate stage of wellbore construction. Differences in the planned and measured azimuth and inclination angles along with changes in measured depth are used to generate steering commands to correct the well path and maintain its direction and inclination in accordance with the prescribed plan. In simple terms, this may be true since it may be necessary to minimize deviation from a planned well path. In practice, a number of factors associated with the drilling process may need to be taken into account in the derivation of the steering commands. These may include drill string torque and drag, rate of penetration, and weight-on-bit. This information may be used to determine the relative position of the drilled well with respect to a planned path, its rate of closure, and a strategy for achievement of a smooth transition to a planned drilling trajectory.

An alternative process mechanization is shown in method 500 of FIG. 5 in which magnetometer data or accelerometer data, or a combination of gyroscopic sensor data, magnetometer data, and accelerometer data may be used to provide stationary orientation information to initialize continuous gyroscopic data processing.

FIG. 5 illustrates a process flow diagram of a method 500 for implementing sensor integration in accordance with implementations described herein.

It should be understood that even though method 500 may indicate a particular order of operation execution, in some cases, various certain portions of the operations may be executed in a different order, and on different systems. In other cases, additional operations and/or steps may be added to and/or omitted from method 500. Method 500 may be implemented as a program or software instruction process that may be used for implementing sensor integration for enhanced steering control of a downhole drilling tool as described herein. Also, if implemented in software, various instructions related to implementing method 500 may be stored in memory and/or a database. For instance, a computer or various other types of computing devices (e.g., computer system 600 shown in FIG. 6) having a processor (or controller) and memory may be configured to perform method 500 in accordance with schemes and techniques described herein.

As described and shown in reference to FIG. 5, method 500 may be utilized for implementing sensor integration for enhanced steering control of a downhole drilling tool in accordance with various schemes and techniques described herein above.

At block 510, method 500 may monitor tool motion, and at block 520, method 500 may collect sensor measurements. When the downhole drilling tool is stationary, at block 530, method 500 may compute static tool orientation. In this instance, method 500 may use magnetometer data and accelerometer data, or method 500 may use some combination of gyroscopic data, magnetometer data, and accelerometer data.

In some implementations, initializing a continuous computation process may be achieved when drilling starts. When the downhole drilling tool is moving, at block 540, method 500 may initialize continuous gyroscopic computation of tool orientation, which may refer to computing dynamic tool orientation during downhole drilling. In this instance, the continuous gyroscopic computation of tool orientation may be computed with one or more of equations (5), (6), and (7).

At block 550, a planned well path direction may be provided, and at block 560, method 500 may compare a measured (or computed) direction of the well path with the planned direction of the well path. Also, at block 570, method 500 may compute steering commands for controlling the drilling trajectory of the downhole drilling tool.

Figure 6:
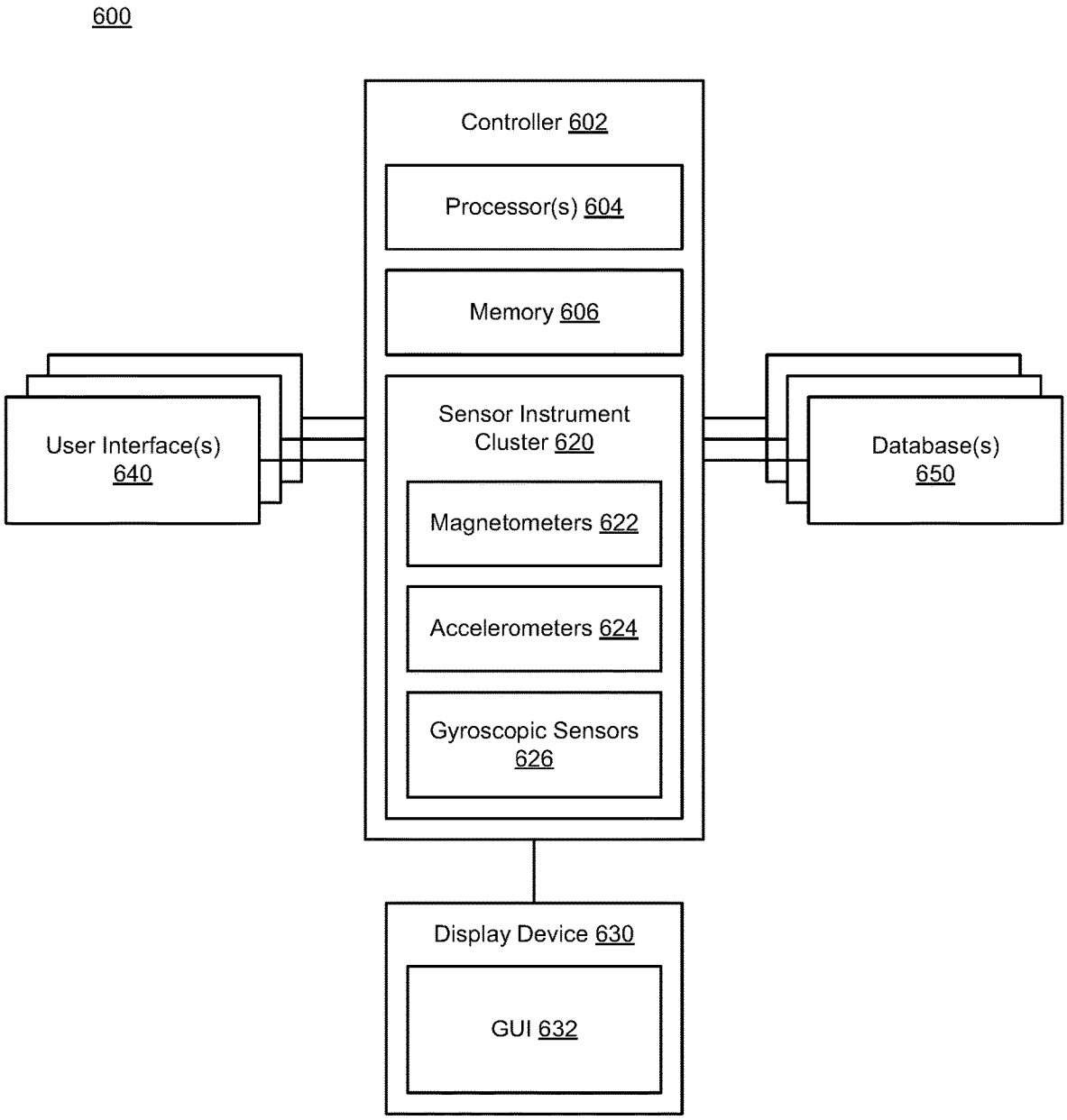
FIG. 6 illustrates a block diagram of an apparatus for implementing sensor integration in accordance with various implementations described herein.

FIG. 6 illustrates a diagram of an apparatus 600 for implementing sensor integration for enhanced steering control of a drilling tool in accordance with various implementations described herein.

In reference to FIG. 6, the apparatus 600 may be implemented as a computer system or computing device or controller 602 for implementing sensor integration related to enhancing steering control of a downhole drilling tool (e.g., RSS drilling tool), thereby transforming the controller 602 into a special purpose machine dedicated to multi-sensor integration, as described herein. Thus, in various implementations, the controller 602 may include standard element(s) and/or component(s), including one or more processor(s) 604, memory 606 (e.g., non-transitory computer-readable storage medium), peripherals, power, and various other computing elements and/or components that are not specifically shown in FIG. 6. Further, as shown in FIG. 6, the apparatus 600 may be associated with a display device 630 (e.g., a monitor or other display) that may be used to provide a graphical user interface (GUI) 632. In some implementations, the GUI 632 may be used to receive input from a user (e.g., user input) associated with the apparatus 600. In some other implementations, one or more other user interfaces (UI) 620 (e.g., a keyboard or similar) may be used to receive input from one or more users (e.g., user input) associated with multi-sensor integration with the apparatus 600. In addition, the apparatus 600 may be associated with one or more databases (e.g., database(s) 650) that may be configured to store data and information related to multi-sensor integration.

Accordingly, the apparatus 600 may include the controller 602 and instructions stored and/or recorded on the computer-readable medium 606 (or one or more databases 650) and executable by the one or more processors 604. The apparatus 600 may include the display device 630 for providing output to a user, and the display device 630 may also include the GUI 632 for receiving input from the user. Further, one or more UIs 620 may be used for receiving input from the user.

In some implementations, the controller 602 may include a sensor instrument cluster 620 having one or more magnetometers 622, accelerometers 624, and gyroscopic sensors 626. In this instance, the controller 602 may communicate with the instrument cluster 620, receive measurement data from the accelerometers 624 and the gyroscopic sensors 626, and acquire a computed tool orientation of a drilling tool (e.g., the downhole drilling tool 100 of FIGS. 1A-1B) based on measurement data from the accelerometers 624 and the gyroscopic sensors 626. Further, the controller 602 may generate tool steering commands for the drilling tool based on a difference between a planned tool orientation and the computed tool orientation. In some instances, the controller 602 may also receive measurement data from the magnetometers 622, and in this instance, the controller 602 may acquire the computed tool orientation of the drilling tool based on the measurement data received from one or more of the accelerometers 624, the gyroscopic sensors 626, and the magnetometers 622. The planned tool orientation is derived from predefined trajectory information, and the computed tool orientation is derived from the measurement data received from the accelerometers and the gyroscopic sensors. For instance, accelerometer measurement data provides a specific force due to gravity, and gyroscopic measurement data provides an angular rate.

In some implementations, as described herein above, the apparatus 600 may be used for steering control of the drilling tool (e.g., the downhole drilling tool 100 of FIGS. 1A-1B), and the drilling tool may be implemented with a rotary steerable system (RSS) drilling tool. Also, in some instances, the controller 602 derives directional drilling data from the measurement data for enhancing the steering control of the drilling tool. In addition, the drilling tool has a drill bit, and the accelerometers 624 and the gyroscopic sensors may generate the measurement data near the drill bit of the drilling tool so that the controller 602 may thereby generate near-bit azimuth data for the drill bit of the drilling tool based on the measurement data.

In some implementations, the measurement data may include a collection of continuous gyroscopic measurement data and continuous accelerometer measurement data during active drilling with the drilling tool. In other implementations, the measurement data includes a collection of static gyroscopic measurement data and static accelerometer measurement data when drilling with the drilling tool ceases. In other implementations, the measurement data includes a collection of measurement data including one or more of planned tool orientation data, measured tool orientation data, and computed tool orientation data. Further, a computed deviation between the planned tool orientation data and the computed tool orientation data is used generate steering commands to correct the drilling trajectory of the drilling tool in a wellbore.

During active and inactive drilling with the drilling tool, the controller 602 may continuously acquire the computed tool orientation of the drilling tool based on the various measurement data from the accelerometers and the gyroscopic sensors. In some cases, the controller 602 continuously measures a tool orientation of the drilling tool in a wellbore based on the measurement data from the accelerometers and the gyroscopic sensors, and the controller 602 continuously acquires the computed tool orientation of the drilling tool in the wellbore based on the measurement data from the accelerometers and the gyroscopic sensors. Also, in this instance, the controller 602 may continuously generate the tool steering commands based on a deviation of a measured tool orientation from a planned drilling trajectory of the drilling tool in a wellbore.

Thus, in some implementations, the controller 602 may generate one or more steering commands for actively guiding the drilling tool along a guided drilling trajectory based on a deviation of the computed tool orientation of the drilling tool from a planned drilling trajectory. In some cases, the gyroscopic measurement data may include static gyroscopic measurement data generated and received during stationary positioning of the drilling tool, and also, the gyroscopic measurement data may include dynamic gyroscopic measurement data generated and received during active drilling operation of the drilling tool. Also, in some cases, the controller 602 may continuously generate the tool steering commands based on a combination of one or more of the gyroscopic measurement data, the accelerometer measurement data, and the magnetometer measurement data.

Further, in some implementations, the controller 602 may generate stationary data at drill pipe connections using the gyroscopic measurement data and accelerometer measurement data, and the controller 602 may also generate stationary data at drill pipe connections using the gyroscopic measurement data and magnetometer measurement data. In other implementations, the controller 602 may generate weighted average survey data based on the gyroscopic measurement data and the magnetometer measurement data, and the controller 602 may also generate statistical estimation data based on the gyroscopic measurement data and the magnetometer measurement data using statistical estimation procedures. In addition, the controller 602 may avoid (or bypass or deactivate or inhibit or restrict) use of magnetometers and/or the magnetometer measurement data associated therewith in regions of external magnetic interference.

As such, in some implementations, the controller 602 is operative to provide enhanced directional drilling in a wellbore and associated data close to the drill bit of a downhole drilling tool so as to provide enhanced wellbore trajectory control. The controller 602 may be part of directional survey instrumentation 120 (i.e., sensor instrument cluster) of the drilling tool 100, as described in reference to FIGS. 1A, 1B.

The measurement data may include the various sensor measurement data that is generated by the drilling tool 100 (e.g., sensor measurements provided by the various sensors (e.g., gyroscopic sensors, accelerometers, and magnetometers) of the directional survey instrumentation 120. The controller 602 may also be operative to correct magnetic MWD survey data during the drilling process, and the controller 602 may be part of the drilling tool 100 (FIGS. 1A-1B) or located at the surface 180. The sensor measurement data may be generated by the sensors in the sensor instrument cluster 120 of the downhole drilling tool 100 (e.g., sensor measurements may be indicative of locations of the sensors within the wellbore 105 as a function of position along the wellbore 105). The at least one computer-readable memory 606 may be in any of several forms. For instance, the at least one computer-readable memory 606 may include read-only memory (ROM), random access memory DRAM, flash memory, hard disk drive, compact disk, digital video disk, etc. for storing and/or recording operational parameters, casing orientation, location coordinates, or other related information associated with the wellbore 105, the downhole drilling tool 100, and/or the sensors in the sensor instrument cluster 120.

For reference, U.S. patent application Ser. No. 14/301,123, entitled "POSITIONING TECHNIQUES IN MULTI-WELL ENVIRONMENTS", filed Jun. 10, 2014, is incorporated herein by reference in its entirety. Accordingly, the following describes implementation of example methods that may be used to determine various positions of multiple wells in close proximity to each other using, e.g., gyroscopic measurements in conjunction with magnetic measurements. In some implementations, more precise ranging measurements may be generated though the availability of accurate gyroscopic measurements of azimuth to supplement the magnetic ranging process. This option may be used in various well applications, including but not limited to, twin wells for steam assisted gravity drainage (SAGD), in-fill drilling, target interceptions, coal bed methane (CBM) well interceptions, relief well drilling and river crossings.

In reference to FIG. 6, the apparatus 600 is illustrated using various functional blocks or modules that represent discrete functionality. However, it should be understood that such illustration is provided for clarity and convenience, and therefore, it should be appreciated that the various functionalities may overlap or be combined within a described block(s) or module(s), and/or may be implemented by one or more additional block(s) or module(s) that are not specifically illustrated in FIG. 6. Further, it should be understood that various standard and/or conventional functionality that may be useful to the apparatus 600 of FIG. 6 may be included as well even though such standard and/or conventional elements are not illustrated explicitly, for the sake of clarity and convenience.

Figure 7:
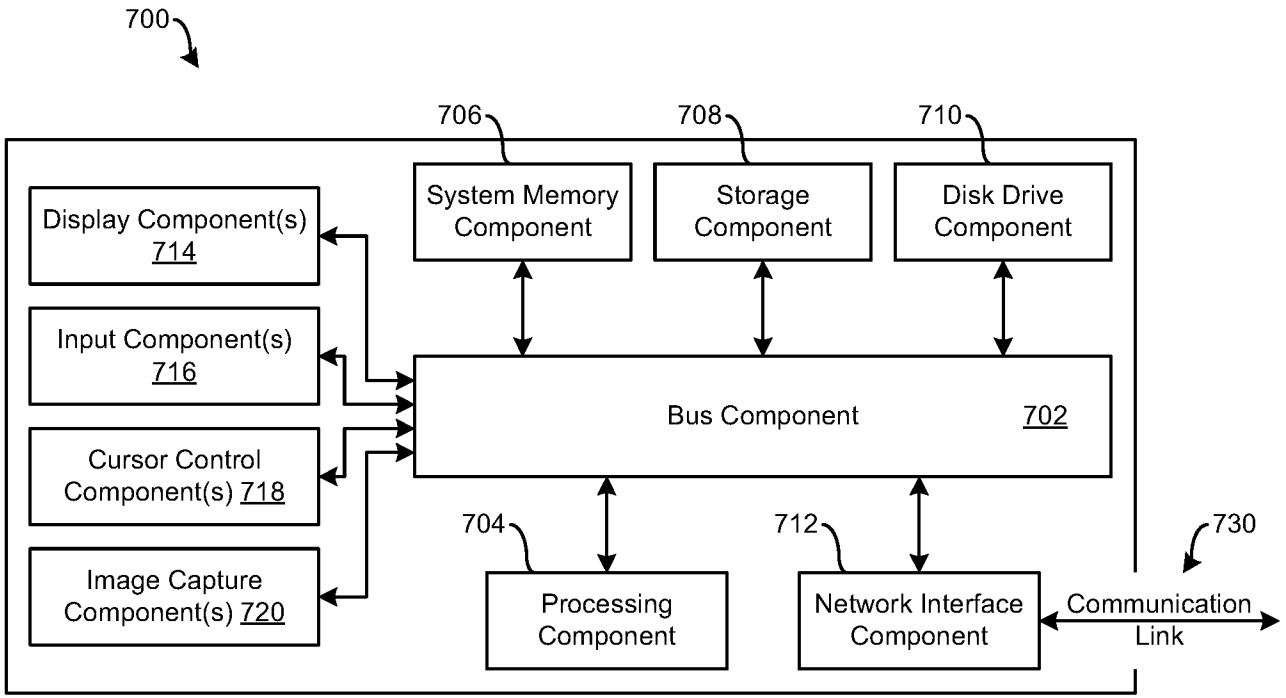
FIG. 7 illustrates a diagram of a computing system in accordance with various implementations described herein.

FIG. 7 illustrates a block diagram of a computing system 700 that is suitable for implementing various computers, computing devices, and/or other user based devices, such as, e.g., controller 602 of FIG. 6. In some implementations, the controller 602 may comprise a computing device having network communication capability to communicate with one or more other computing devices via a communication network. In addition, the computing system 700 may be used for implementing sensor integration for enhanced steering control of a drilling tool (e.g., the drilling tool 100 of FIGS. 1A-1B).

In various implementations, the computer system 700 may include a bus 702 and/or some other communication mechanism for communicating data and information, which interconnects subsystems and components, such as a processing component 704 (e.g., processor, micro-controller, digital signal processor (DSP), etc.), a system memory component 706 (e.g., RAM), a static storage component 708 (e.g., ROM), a disk drive component 710 (e.g., magnetic and/or optical), a network interface component 712 (e.g., transceiver, modem, or Ethernet card), a display component 714 (e.g., CRT or LCD), one or more input components 716 (e.g., keyboard, audio interface, voice recognizer, etc.), a cursor control component 718 (e.g., mouse or trackball), and an image or video capture component 720 (e.g., analog or digital camera). The disk drive component 710 may be a database having one or more disk drive components.

The computer system 700 may perform specific operations by the processing component 704 executing one or more sequences of one or more instructions stored in the system memory component 706. The instructions are read into the system memory component 706 from another computer readable medium, such as, e.g., the static storage component 708 and/or the disk drive component 710. In other embodiments, hard-wired circuitry may be used in place of or in combination with software instructions to implement various methods and techniques as described herein.

The computer system 700 may include logic that may be encoded in a computer readable medium, which may refer to any medium that participates in providing various instructions to the processor 704 for execution. Such a computer readable medium may take many forms, including but not limited to, non-volatile media and volatile media. In various instances, non-volatile media may include optical or magnetic disks, such as, e.g., the disk drive component 710, and volatile media may include dynamic memory, such as, e.g., the system memory component 706. In some instances, data and information related to executing instructions may be transmitted to the computer system 700 via transmission media, such as in the form of acoustic or light waves, including those generated during radio wave and infrared data communications. Transmission media may include coaxial cables, copper wire, and fiber optics, including wires that comprise the bus 702.

Some common forms of computer readable media may include a floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, carrier wave, or any other medium from which a computer is adapted to read.

In various implementations, execution of instruction sequences to practice the methods and techniques described herein may be performed by the computer system 700. In various other implementations, a plurality of computer systems 700 coupled by the communication link 730 (e.g., communication network, such as a LAN, WLAN, PTSN, and/or various other wired or wireless networks, including telecommunications, mobile, and cellular phone networks) may perform instruction sequences to practice the methods and techniques in coordination with one another.

The computer system 700 may transmit and/or receive data, information, and instructions, including messages pertaining to one or more programs (e.g., application code) via the communication link 730 and the communication interface 712. The program code may be executed by the processor 704 as received and/or stored in the disk drive component 710 or some other non-volatile storage component for execution.

Where applicable, various embodiments described herein may be implemented using hardware, software, or some combination of hardware and software. Also, where applicable, various hardware components and/or software components set forth herein may be combined into composite components comprising software, hardware, and/or both without departing from methods and techniques described herein. Further, where applicable, various hardware components and/or software components set forth herein may be separated into sub-components comprising software, hardware, or both without departing from methods and techniques described herein. In addition, where applicable, software components may be implemented as hardware components and vice-versa.

Software, in accordance with various embodiments described herein, such as program code, data, and/or other information, may be stored and/or recorded on one or more computer readable mediums. It is also contemplated that software identified herein may be implemented using one or more general purpose or specific purpose computers and/or computer systems, networked and/or otherwise. Where applicable, the ordering of various methods described herein may be changed, combined into composite methods, and/or separated into sub-methods to provide features described herein.

Figure 8:
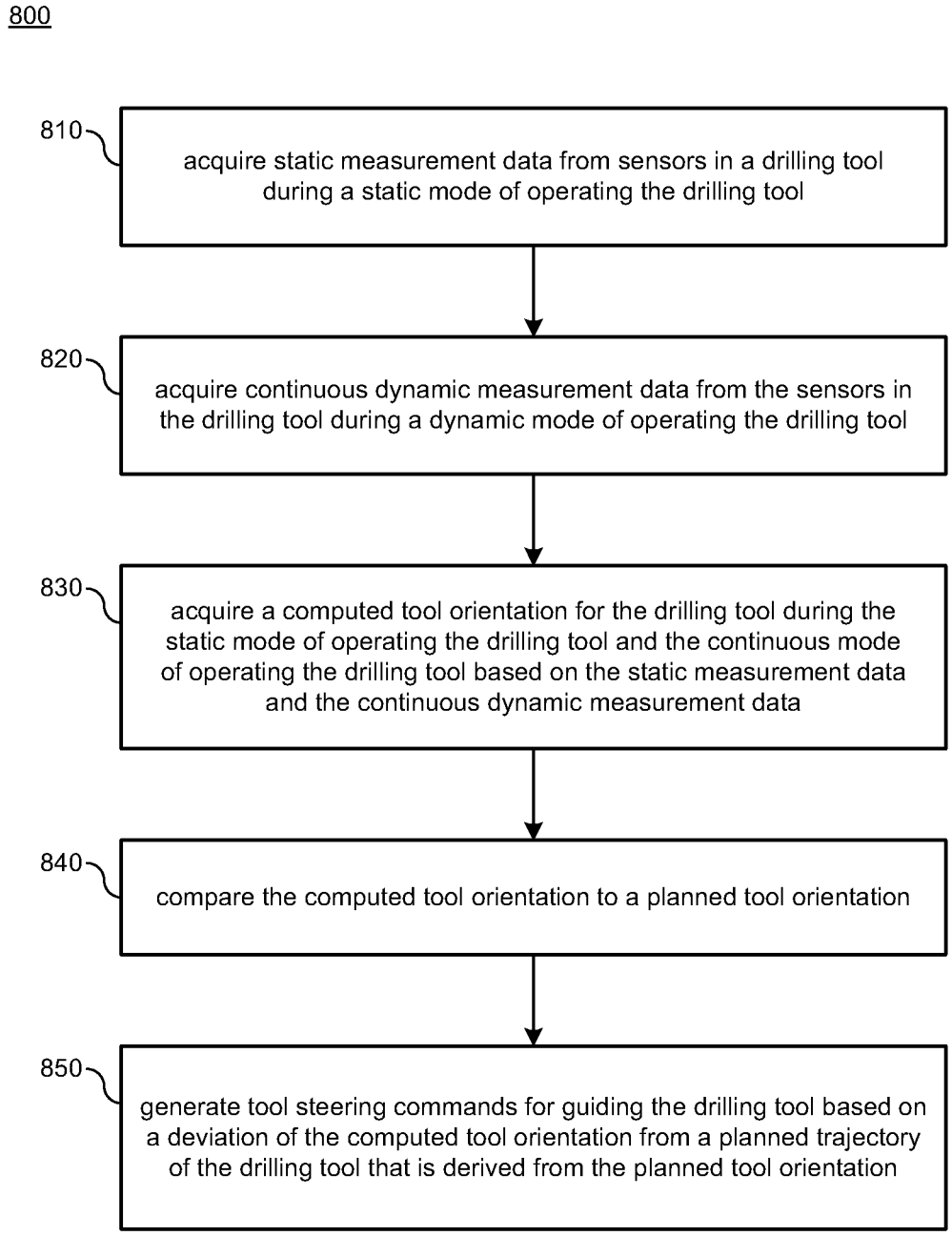
FIG. 8 illustrates a process flow diagram of a method for implementing sensor integration in accordance with implementations described herein.

FIG. 8 illustrates a process flow diagram of a method 800 for implementing sensor integration in accordance with implementations described herein.

It should be understood that even though method 800 may indicate a particular order of operation execution, in some cases, various certain portions of the operations may be executed in a different order, and on different systems. In other cases, additional operations and/or steps may be added to and/or omitted from method 800. Method 800 may be implemented as a program or software instruction process that may be used for implementing sensor integration for enhanced steering control of a downhole drilling tool as described herein. Also, if implemented in software, various instructions related to implementing method 800 may be stored in memory and/or a database. For instance, a computer or various other types of computing devices (e.g., computer system 600 shown in FIG. 6) having a processor (or controller) and memory may be configured to perform method 800 in accordance with schemes and techniques described herein.

At block 810, method 800 may acquire static measurement data from sensors in a drilling tool during a static mode of operating the drilling tool. In some instances, the static measurement data may include one or more of static gyroscopic measurement data, static accelerometer measurement data, and static magnetometer measurement data.

At block 820, method 800 may acquire continuous dynamic measurement data from the sensors in the drilling tool during a dynamic mode of operating the drilling tool. In some instances, the continuous dynamic measurement data may include one or more of continuous dynamic gyroscopic measurement data, continuous dynamic accelerometer measurement data, and continuous dynamic magnetometer measurement data.

At block 830, method 800 may acquire a computed tool orientation for the drilling tool during the static mode of operating the drilling tool and the continuous mode of operating the drilling tool based on the static measurement data and the continuous dynamic measurement data.

At block 840, method 800 may compare the computed tool orientation to a planned tool orientation. At block 850, method 800 may generate tool steering commands for guiding the drilling tool based on a deviation of the computed tool orientation from a planned trajectory of the drilling tool that is derived from the planned tool orientation.

In some implementations, only the magnetometer measurement data and the accelerometer measurement data is used if there is movement of the drill string or the gyroscopic sensor readings fail quality control (QC) parameters. Also, the gyroscopic measurement data is used in conjunction with the magnetometer measurement data to satisfy ranging criteria when attempting to drill a well a fixed distance from an existing well. In some cases, the gyroscopic measurement data is used in conjunction with the magnetometer measurement data to satisfy ranging criteria when attempting to intercept an existing well. Further, the gyroscopic measurement data is used in conjunction with the magnetometer measurement data to satisfy ranging criteria when attempting to avoid a collision with a nearby well.

It should be intended that the subject matter of the claims not be limited to the implementations and illustrations provided herein, but include modified forms of those implementations including portions of implementations and combinations of elements of different implementations in accordance with the claims. It should be appreciated that in the development of any such implementation, as in any engineering or design project, numerous implementation-specific decisions should be made to achieve developers' specific goals, such as compliance with system-related and business related constraints, which may vary from one implementation to another. Moreover, it should be appreciated that such a development effort may be complex and time consuming, but would nevertheless be a routine undertaking of design, fabrication, and manufacture for those of ordinary skill having benefit of this disclosure.

Reference has been made in detail to various implementations, examples of which are illustrated in the accompanying drawings and figures. In the following detailed description, numerous specific details are set forth to provide a thorough understanding of the disclosure provided herein. However, the disclosure provided herein may be practiced without these specific details. In some other instances, well-known methods, procedures, components, circuits and networks have not been described in detail so as not to unnecessarily obscure details of the embodiments.

It should also be understood that, although the terms first, second, etc. may be used herein to describe various elements, these elements should not be limited by these terms. These terms are only used to distinguish one element from another. For instance, a first element could be termed a second element, and, similarly, a second element could be termed a first element. The first element and the second element are both elements, respectively, but they are not to be considered the same element.

The terminology used in the description of the disclosure provided herein is for the purpose of describing particular implementations and is not intended to limit the disclosure provided herein. As used in the description of the disclosure provided herein and appended claims, the singular forms "a," "an," and "the" are intended to include the plural forms as well, unless the context clearly indicates otherwise. The term "and/or" as used herein refers to and encompasses any and all possible combinations of one or more of the associated listed items. The terms "includes," "including," "comprises," and/or "comprising," when used in this specification, specify a presence of stated features, integers, steps, operations, elements, and/or components, but do not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. The terms "up" and "down"; "upper" and "lower"; "upwardly" and "downwardly"; "below" and "above"; and other similar terms indicating relative positions above or below a given point or element may be used in connection with some implementations of various technologies described herein.

While the foregoing is directed to implementations of various techniques described herein, other and further implementations may be devised in accordance with the disclosure herein, which may be determined by the claims that follow.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus, comprising:

an instrument cluster having accelerometers and gyroscopic sensors; and a controller that communicates with the instrument cluster, receives measurement data from the accelerometers and the gyroscopic sensors, acquires a computed tool orientation of a drilling tool based on the measurement data from the accelerometers and the gyroscopic sensors, generates tool steering commands for the drilling tool based on a difference between a planned tool orientation and the computed tool orientation, and initializes a continuous tool face, inclination and azimuth computation process using stationary survey data when drilling recommences after cessation; and wherein the measurement data comprises dynamic measurement data generated and received during active drilling operation of the drilling tool.

2. The apparatus of claim 1, wherein the apparatus is used for steering control of the drilling tool, and wherein the drilling tool is a rotary steerable drilling tool, and wherein the controller derives directional drilling data from the measurement data for enhancing the steering control of the drilling tool.

3. The apparatus of claim 1, wherein the drilling tool has a drill bit, and wherein the accelerometers and the gyroscopic sensors generate the measurement data near the drill bit of the drilling tool so that the controller generates near-bit azimuth data for the drill bit of the drilling tool based on the measurement data.

4. The apparatus of claim 1, wherein the instrument cluster includes magnetometers, wherein the controller receives measurement data from the magnetometers, and wherein the controller acquires the computed tool orientation of the drilling tool based on the measurement data received from the accelerometers, the gyroscopic sensors and the magnetometers.

5. The apparatus of claim 1, wherein the measurement data includes continuous gyroscopic measurement data and continuous accelerometer measurement data during active drilling with the drilling tool.

6. The apparatus of claim 1, wherein the measurement data includes static gyroscopic measurement data and static accelerometer measurement data when drilling with the drilling tool ceases.

7. The apparatus of claim 1, wherein the planned tool orientation is derived from predefined trajectory information, wherein the computed tool orientation is derived from the measurement data received from the accelerometers and the gyroscopic sensors, and wherein accelerometer measurement data provides a specific force due to gravity, and wherein gyroscopic measurement data provides an angular rate.

8. The apparatus of claim 1, wherein during active drilling and stationary periods, the controller continuously acquires the computed tool orientation of the drilling tool based on the measurement data from the accelerometers and the gyroscopic sensors.

9. The apparatus of claim 1, wherein the controller continuously measures a tool orientation of the drilling tool in a wellbore based on the measurement data from the accelerometers and the gyroscopic sensors, and wherein the controller continuously acquires the computed tool orientation of the drilling tool in the wellbore based on the measurement data from the accelerometers and the gyroscopic sensors.

10. The apparatus of claim 1, wherein the controller continuously generates the tool steering commands based on a deviation of a computed tool orientation from a planned drilling trajectory of the drilling tool in a wellbore.

11. An apparatus, comprising:

an instrument cluster having gyroscopic sensors; and a controller that communicates with the instrument cluster, receives gyroscopic measurement data from the gyroscopic sensors, and continuously acquires a computed tool orientation of a drilling tool based on the gyroscopic measurement data received from the gyroscopic sensors, generates steering commands for actively guiding the drilling tool along a guided drilling trajectory based on a deviation of the computed tool orientation of the drilling tool from a planned drilling trajectory, and initializes a continuous tool face, inclination and azimuth computation process using stationary survey data when drilling recommences after cessation; and wherein the gyroscopic measurement data comprises dynamic gyroscopic measurement data generated and received during active drilling operation of the drilling tool.

12. The apparatus of claim 11, wherein the apparatus is used for steering control of the drilling tool, wherein the drilling tool is a rotary steerable drilling tool, and wherein the controller derives directional drilling data from the gyroscopic measurement data so as to control direction of the wellbore.

13. The apparatus of claim 11, wherein the drilling tool has a drill bit, and wherein the gyroscopic sensors generate the gyroscopic measurement data close to the drill bit of the drilling tool so that the controller continuously generates near-bit azimuth data for the drill bit of the drilling tool based on the gyroscopic measurement data.

14. The apparatus of claim 11, wherein the gyroscopic measurement data comprises static gyroscopic measurement data generated and received during stationary positioning of the drilling tool.

15. The apparatus of claim 11, wherein the instrument cluster includes one or more accelerometers and magnetometers, and wherein the controller receives accelerometer measurement data from the accelerometers and receives magnetometer measurement data from the magnetometers.

16. The apparatus of claim 15, wherein the controller continuously generates the tool steering commands based on a combination of the gyroscopic measurement data, the accelerometer measurement data, and the magnetometer measurement data.

17. The apparatus of claim 15, wherein the controller generates at least one of: stationary data at drill pipe connections using the gyroscopic measurement data and the accelerometer measurement data, stationary data at drill pipe connections using the gyroscopic measurement data, the accelerometer measurement data, and the magnetometer measurement data, weighted average survey data based on the gyroscopic measurement data and the magnetometer measurement data, and statistical estimation data based on the gyroscopic measurement data and the magnetometer measurement data using statistical estimation procedures.

18. The apparatus of claim 11, wherein the instrument cluster includes one or more magnetometers, and wherein the controller bypasses or deactivates use of the one or more magnetometers and magnetometer measurement data associated therewith in regions of external magnetic interference.

19. A method, comprising:

acquiring static measurement data from sensors in a drilling tool during a static mode of operating the drilling tool, wherein the static measurement data includes one or more of static gyroscopic measurement data, static accelerometer measurement data, and static magnetometer measurement data;

acquiring continuous dynamic measurement data from the sensors in the drilling tool during a dynamic mode of operating the drilling tool, wherein the continuous dynamic measurement data includes one or more of continuous dynamic gyroscopic measurement data, continuous dynamic accelerometer measurement data, and continuous dynamic magnetometer measurement data;

acquiring a computed tool orientation for the drilling tool during the static mode of operating the drilling tool and the dynamic mode of operating the drilling tool based on the static measurement data and the continuous dynamic measurement data;

comparing the computed tool orientation to a planned tool orientation; and generating tool steering commands for guiding the drilling tool based on a deviation of the computed tool orientation from a planned trajectory of the drilling tool that is derived from the planned tool orientation.

20. The method of claim 19, wherein the planned tool orientation is derived from predefined trajectory information, wherein the computed tool orientation is derived from at least one of the static measurement data and the continuous dynamic measurement data received from the sensors, and wherein the static accelerometer measurement data and the continuous dynamic accelerometer measurement data provide a specific force due to gravity, and wherein the static gyroscopic measurement data and the continuous dynamic gyroscopic measurement data provide an angular rate.

* * * * *